US007922540B2

(12) United States Patent
Zhang et al.

(10) Patent No.: US 7,922,540 B2
(45) Date of Patent: Apr. 12, 2011

(54) POWER PLUG HAVING BACKUP FUSE TUBE

(75) Inventors: Yu Liang Zhang, Dongguan (CN); Dong-Hua Nie, Dongguan (CN)

(73) Assignee: Dongguan Unirise Electric Wire & Cable Co., Dongguan, Guangdong (CN)

( * ) Notice: Subject to any disclaimer, the term of this patent is extended or adjusted under 35 U.S.C. 154(b) by 0 days.

(21) Appl. No.: 12/540,714

(22) Filed: Aug. 13, 2009

(65) Prior Publication Data

US 2010/0210143 A1 Aug. 19, 2010

(30) Foreign Application Priority Data

Feb. 16, 2009 (CN) ..... 2009 2 0051262 U
Mar. 13, 2009 (CN) ..... 2009 2 0052560 U

(51) Int. Cl.
*H01R 13/68* (2006.01)

(52) U.S. Cl. ..... 439/620.34; 439/106

(58) Field of Classification Search ..... 439/106, 439/620.2, 620.3, 620.29, 620.34
See application file for complete search history.

(56) References Cited

U.S. PATENT DOCUMENTS

| | | | | |
|---|---|---|---|---|
| 6,267,627 | B1 * | 7/2001 | Lin | 439/620.32 |
| 6,561,673 | B2 * | 5/2003 | Frederick | 362/234 |
| 6,652,321 | B2 * | 11/2003 | Liu | 439/620.3 |
| 7,029,332 | B2 * | 4/2006 | Chien | 439/620.26 |
| 2002/0168890 | A1 * | 11/2002 | Frederick | 439/501 |
| 2002/0168892 | A1 * | 11/2002 | Frederick | 439/501 |
| 2003/0139097 | A1 * | 7/2003 | Liu | 439/622 |
| 2010/0210143 | A1 * | 8/2010 | Zhang et al. | 439/620.34 |

FOREIGN PATENT DOCUMENTS

CN 200920051262.5 1/2010

* cited by examiner

*Primary Examiner* — James Harvey
(74) *Attorney, Agent, or Firm* — Muncy, Geissler, Olds & Lowe, PLLC

(57) ABSTRACT

A power plug having backup fuse tube, its major objective is that, when a fuse tube is damaged, a replaceable backup fuse tube can be obtained readily and promptly. The power plug has a backup fuse tube with pins and a casing, lead-out wires. A cavity is provided in the casing. The cavity is covered with a matching backup fuse tube holder. On a backside of the backup fuse tube holder a retainer is provided, and a backup fuse tube is placed in the retainer.

1 Claim, 10 Drawing Sheets

POWER PLUG HAVING BACKUP FUSE TUBE

BACKGROUND OF THE INVENTION

1. Field of the Invention

The present invention relates to a power plug, and in particular to a power plug having backup fuse tube, such that when a fuse tube is damaged, a replaceable backup fuse tube can be obtained readily and promptly.

2. The Prior Arts

Presently, the well-known power plug on the market is formed by two pins connected directly with power wires (namely, a fire wire and a zero wire), then injecting PVC into molding. The power plug includes pins, a casing, and lead-out wires. One end of the pin is connected to one end of the lead-out wire in the casing, and the other end of the pin is extended and exposed outside the casing, for inserting into a power socket to guide in the power required, thus transferring the power to an electrical appliance through the lead-out wire; while the casing is used for providing insulation between the respective pins, and making the electric portions insulated from outside. In order to ensure safety of utilizing electricity, in general, a fuse tube is provided in a circuit for protection against overload and short circuit. For the existing prior art in the respect, fuse tube is usually put in a power socket or a power switch, refer to Application Case No. 200920051262.5 of PRC [power plug having replaceable fuse tube] of the same Applicant of the present case. Hence, providing a replaceable fuse tube in a power plug that is compatible with the power plug's capacity, is good for the safe utilization of an electrical appliance, and therefore when performing checking and repairing of operation failures or short circuit, this would not affect the normal operations of an electrical appliance. However, when the fuse tube is damaged or burned out, quite often a user will not aware of the magnitude of the fuse tube to be replaced, and even worse, there is no backup fuse tube available to use. As such, this would cause great inconvenience for a user in replacing a damaged fuse tube and would prolong the down-time of an electrical appliance. Therefore, the existing prior art of power plug has much room for improvement.

SUMMARY OF THE INVENTION

In view of the shortcomings and drawbacks of the prior art, the present invention discloses power plug having backup fuse tube, so as to solve the afore-mentioned problems of the prior art.

A major objective of the present invention is to provide power plug having backup fuse tube, such that when a fuse tube is damaged, a replaceable backup fuse tube can be obtained readily and promptly.

In order to achieve the afore-mentioned objective, the present invention discloses a power plug, comprising: pins, a casing, and lead-out wires. Wherein, a cavity is provided in the casing, on the cavity is covered with a matching backup fuse tube holder, on the backside of the backup fuse tube holder is provided with a retainer, and a backup fuse tube is placed in the retainer. The retainer can be a flexible retainer, hereby facilitating holding and taking out the backup fuse tube.

In the present invention, the power plug can be an ordinary power plug. However, in the preferred embodiment, a power plug having replaceable fuse tube is utilized, as mentioned in Application Case No. 200920051262.5 of PRC [power plug having replaceable fuse tube] of the same Applicant of the present case.

In the power plug provided by the present invention, in the casing is provided with an inner frame, which is similar to a box, and in the inner frame is provided with pins, lead-out wires, fuse tube stand. One end of pins and lead-out wire are placed in the inner frame, while other ends extend out of the inner frame and casing. One end of the fuse tube stand is connected to an inner end of a pin, and the other end is connected to an inner end of a lead-out wire. A fuse tube is provided in the fuse tube stand, an inner frame cover is matched with the inner frame and is covered on the inner frame. An opening is provided on the inner frame cover, the opening is matched with a fuse tube cover, the fuse tube cover is placed on the opening of inner frame cover. The casing encircles the inner frame, so that the fuse tube cover extends and exposes out of the casing. When it is able to distinguish between fire wire and ground wire of a pin, one end of fuse tube in connected to a fire wire pin inner end of the plug, and the other end is connected to lead-out wire of fire wire. The fuse tube stand mentioned above means two pairs of mutually insulating metal retainers matching the fuse tube. When a fuse tube is placed in, the two pairs of metal retainers are electrically connecting.

A major advantages of the present invention is that: when a fuse tube is damaged, a replaceable backup fuse tube can be obtained readily and promptly, so that the fuse tube can be replaced in the shortest possible time, hereby facilitating the replacement of fuse tube, and significantly shortening the down-time of an electrical appliance. In particular, in a preferable embodiment of the present invention, the power plug circuit is provided with a replaceable fuse tube, thus rendering fuse tube replacement much more easy and simple, and that is very convenient for users having no knowledge about fuse tube replacement.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions, and advantages of the present invention can be appreciated and understood more thoroughly through the following detailed description with reference to the attached drawings.

Figure 1:
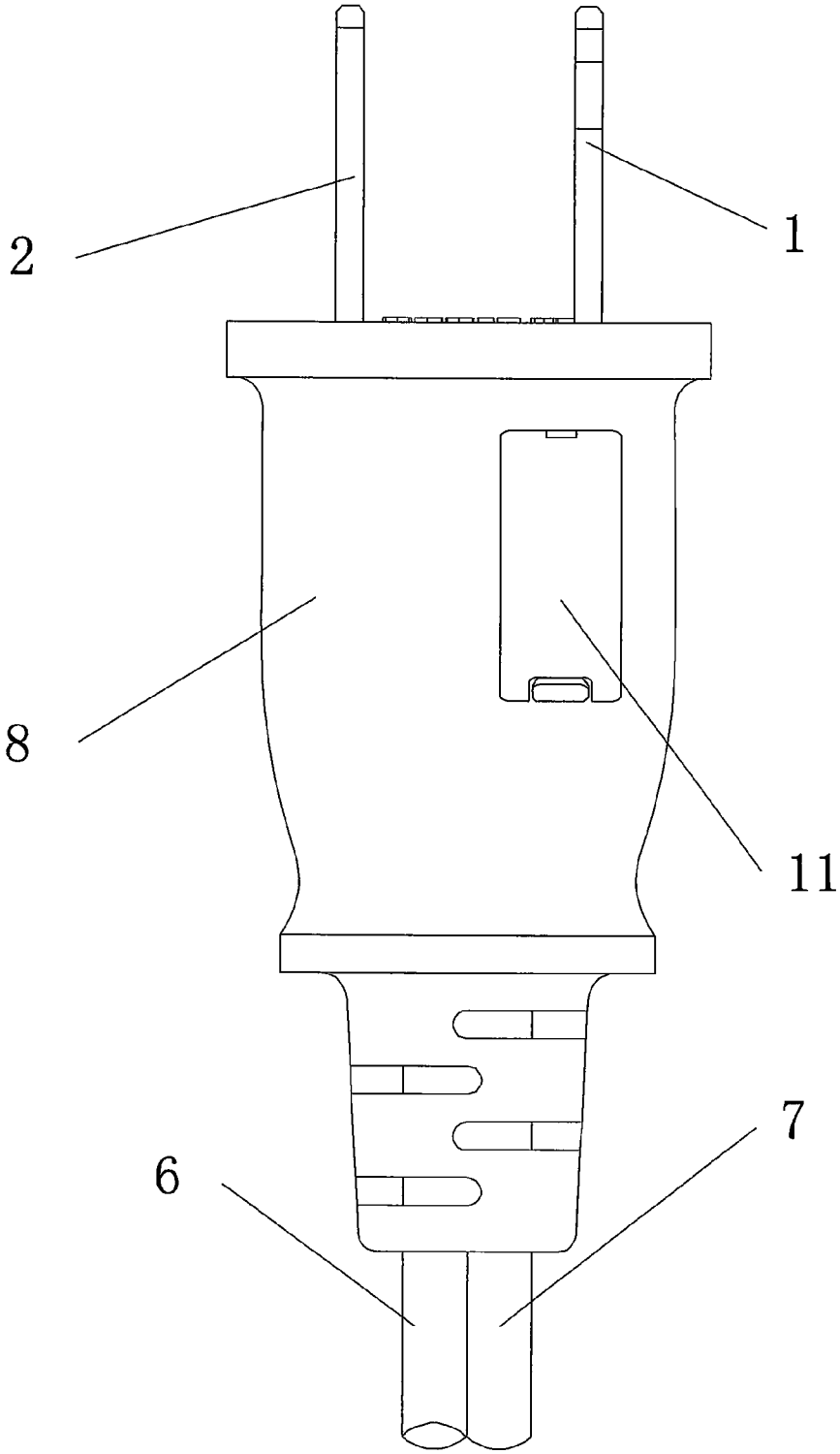
FIG. 1 is a schematic diagram of a power plug having a backup fuse tube according to an embodiment of the present invention.
Figure 2:
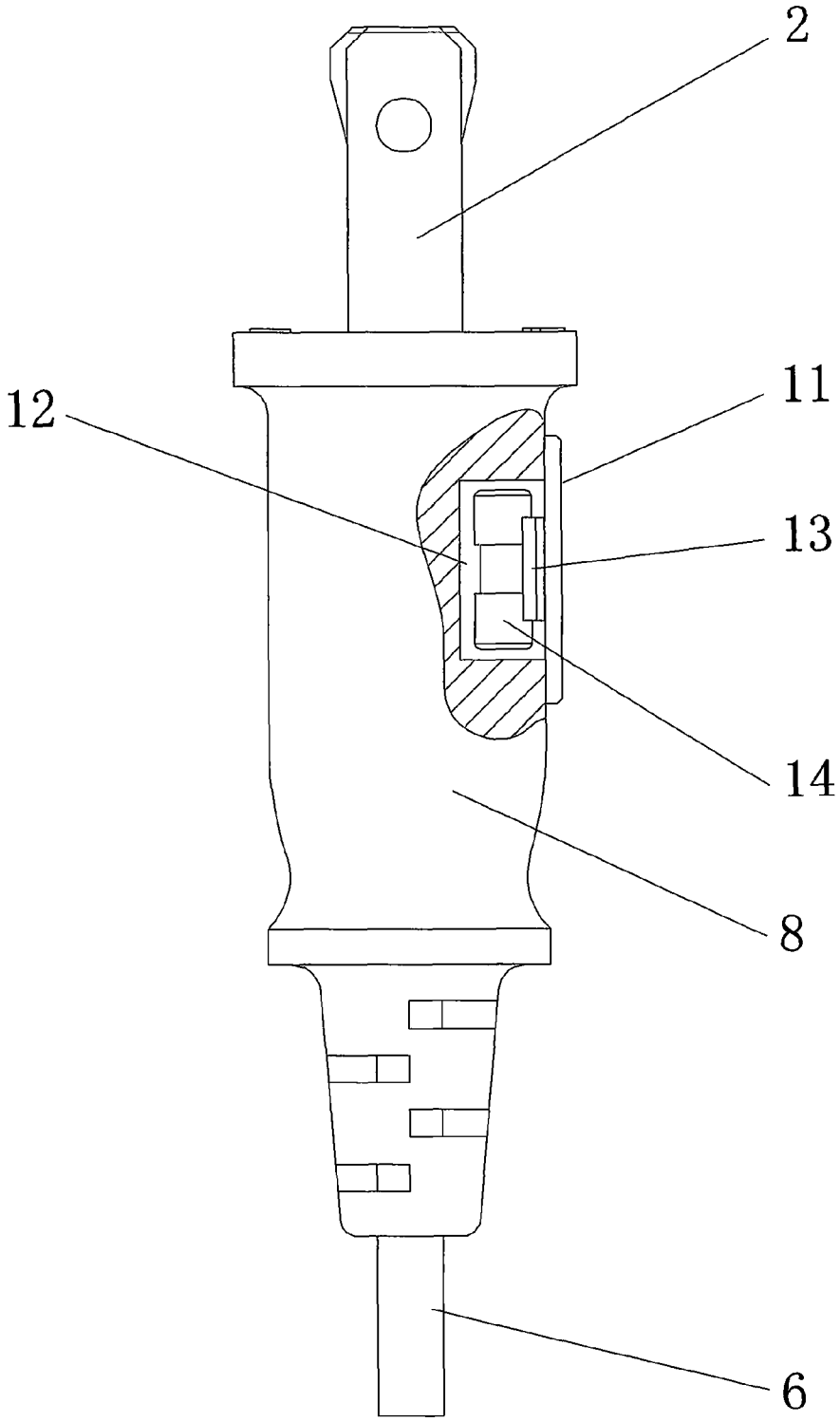
FIG. 2 is a left side view of a power plug having a backup fuse tube according to an embodiment of the present invention.
Figure 3:
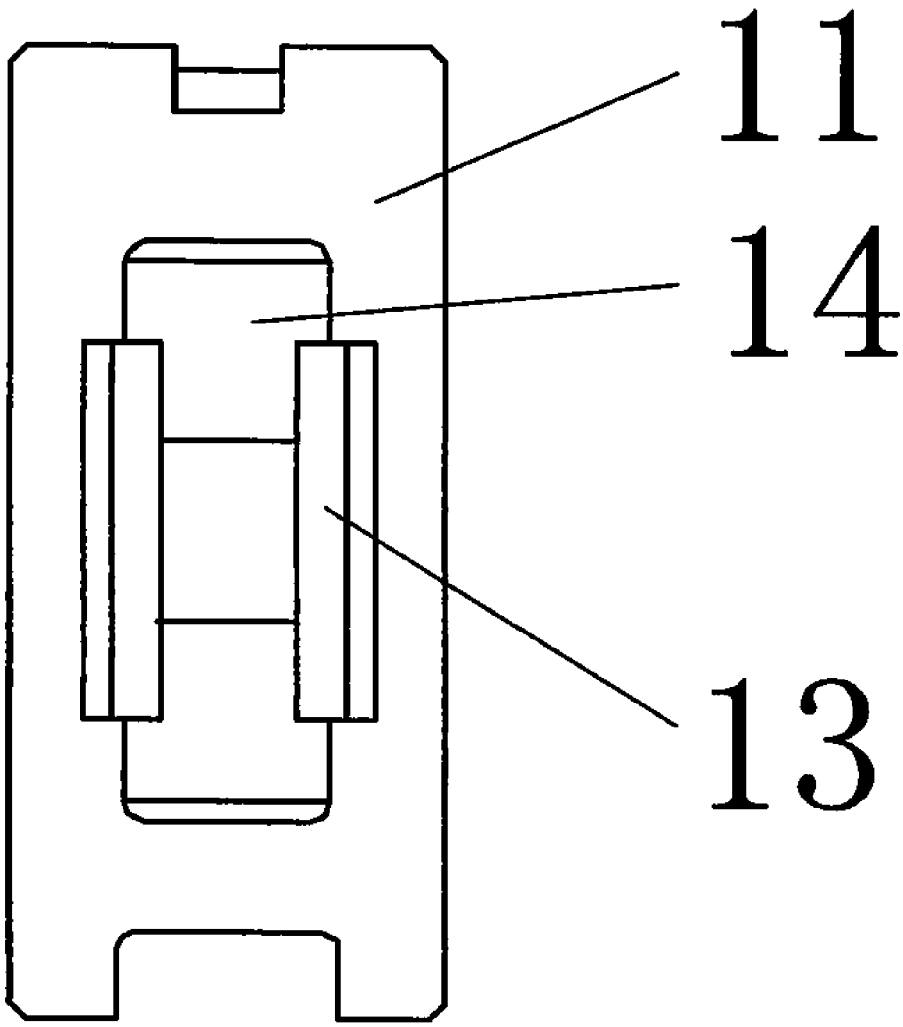
FIG. 3 is a front view of a backup fuse tube holder according to an embodiment of the present invention.
Figure 4:
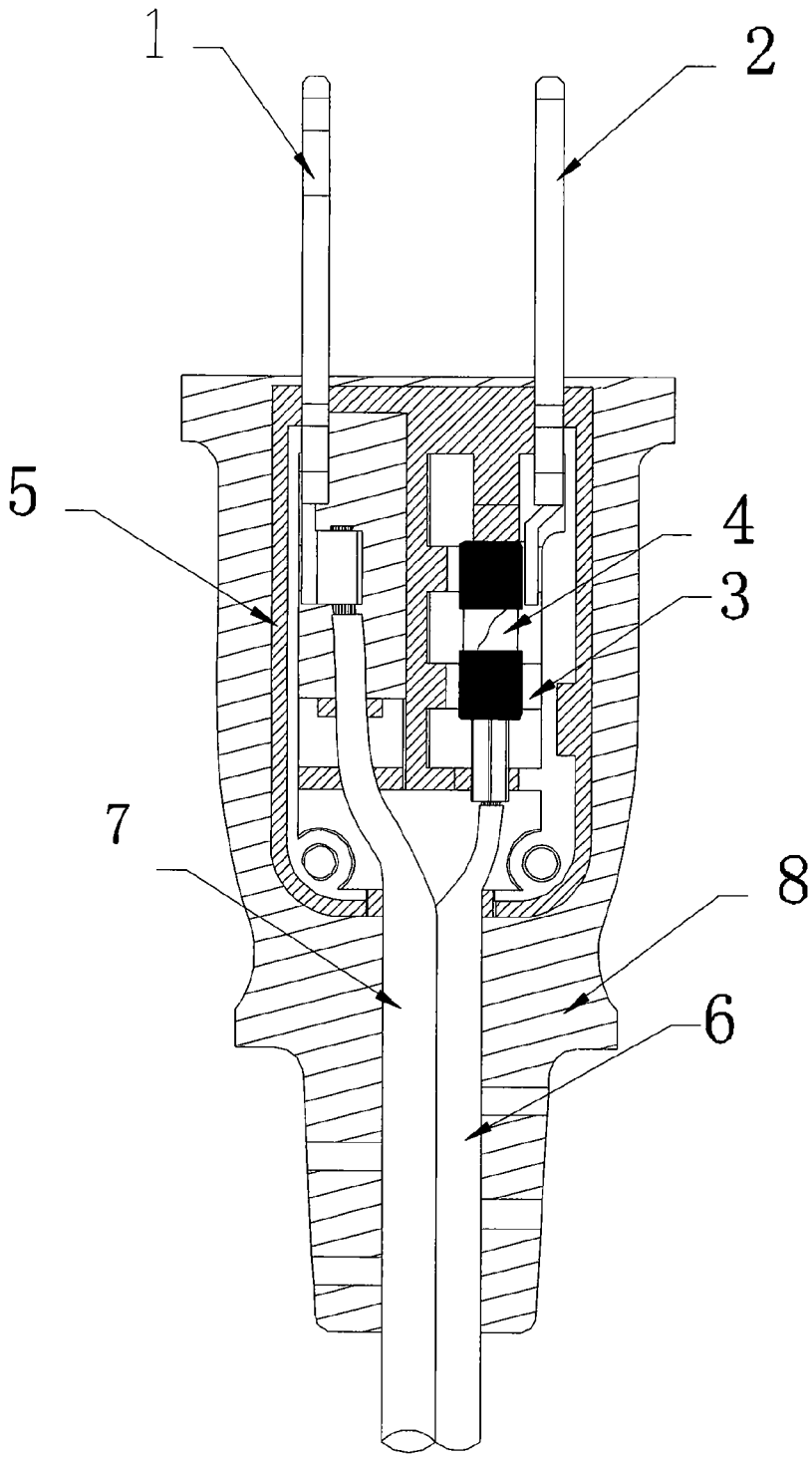
FIG. 4 is a schematic diagram of a reverse side cross section of a power plug according to an embodiment of the present invention.
Figure 5:
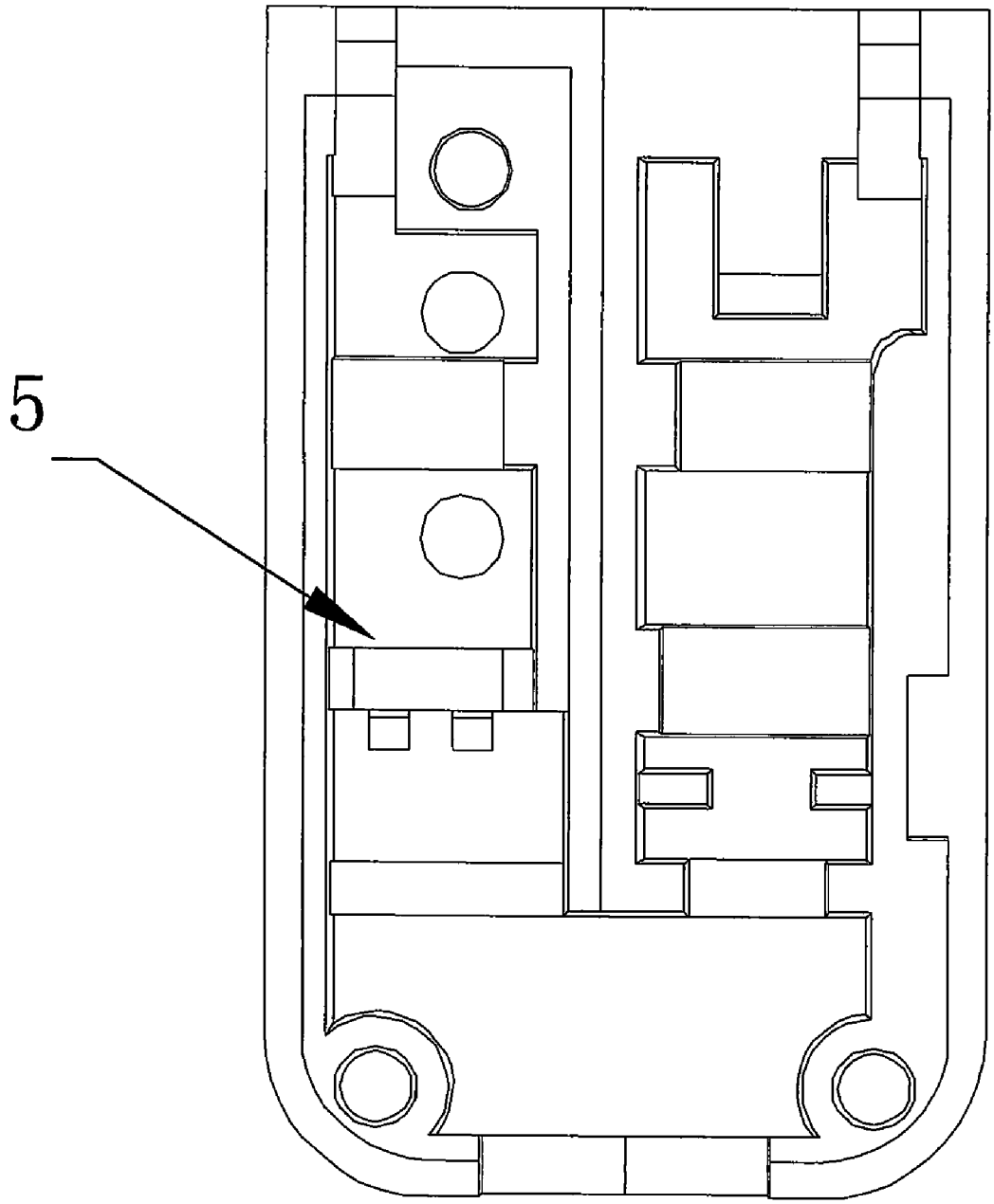
FIG. 5 is a top view of an inner frame according to an embodiment of the present invention.
Figure 6:
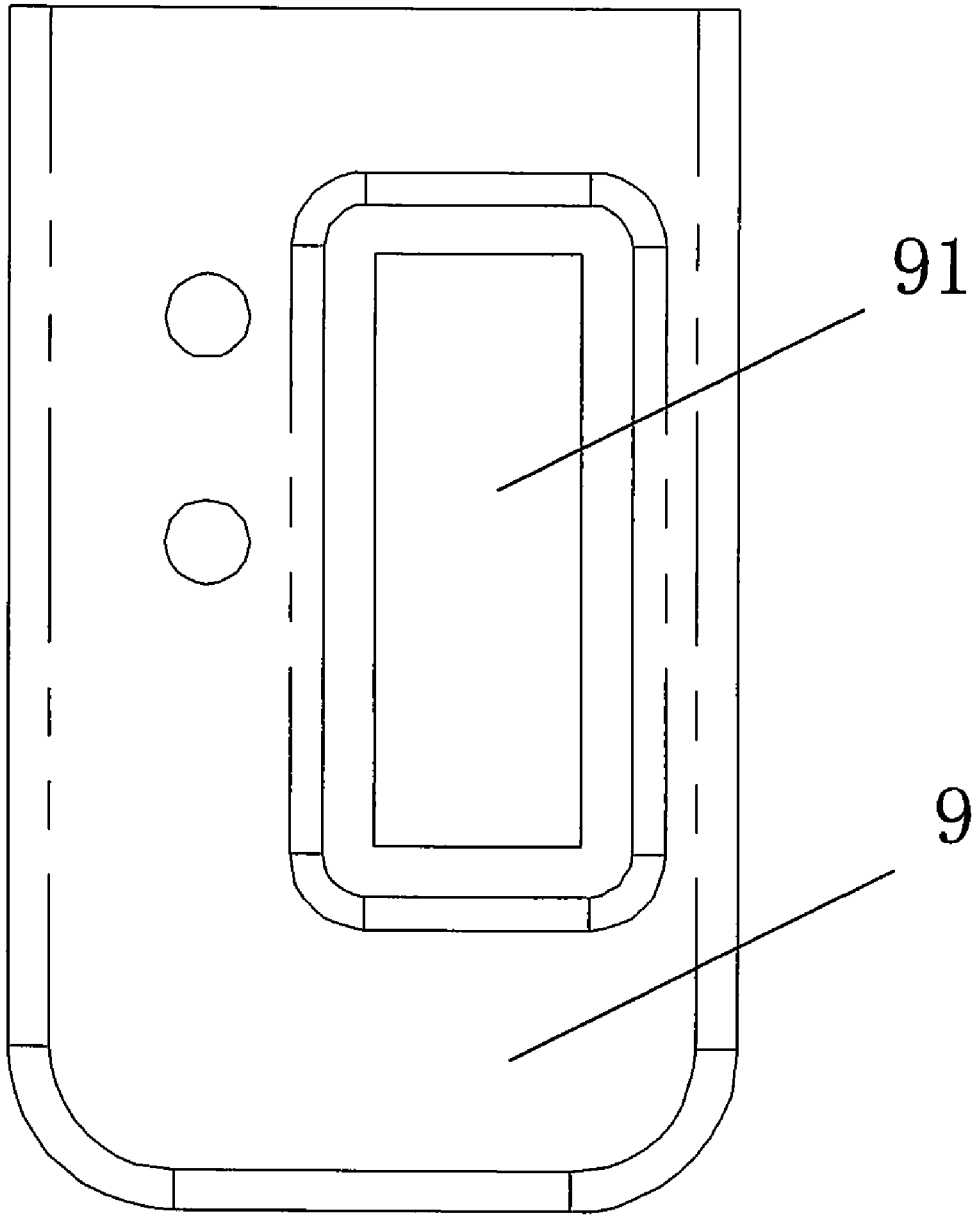
FIG. 6 is a schematic diagram of an inner frame cover according to an embodiment of the present invention.
Figure 7:
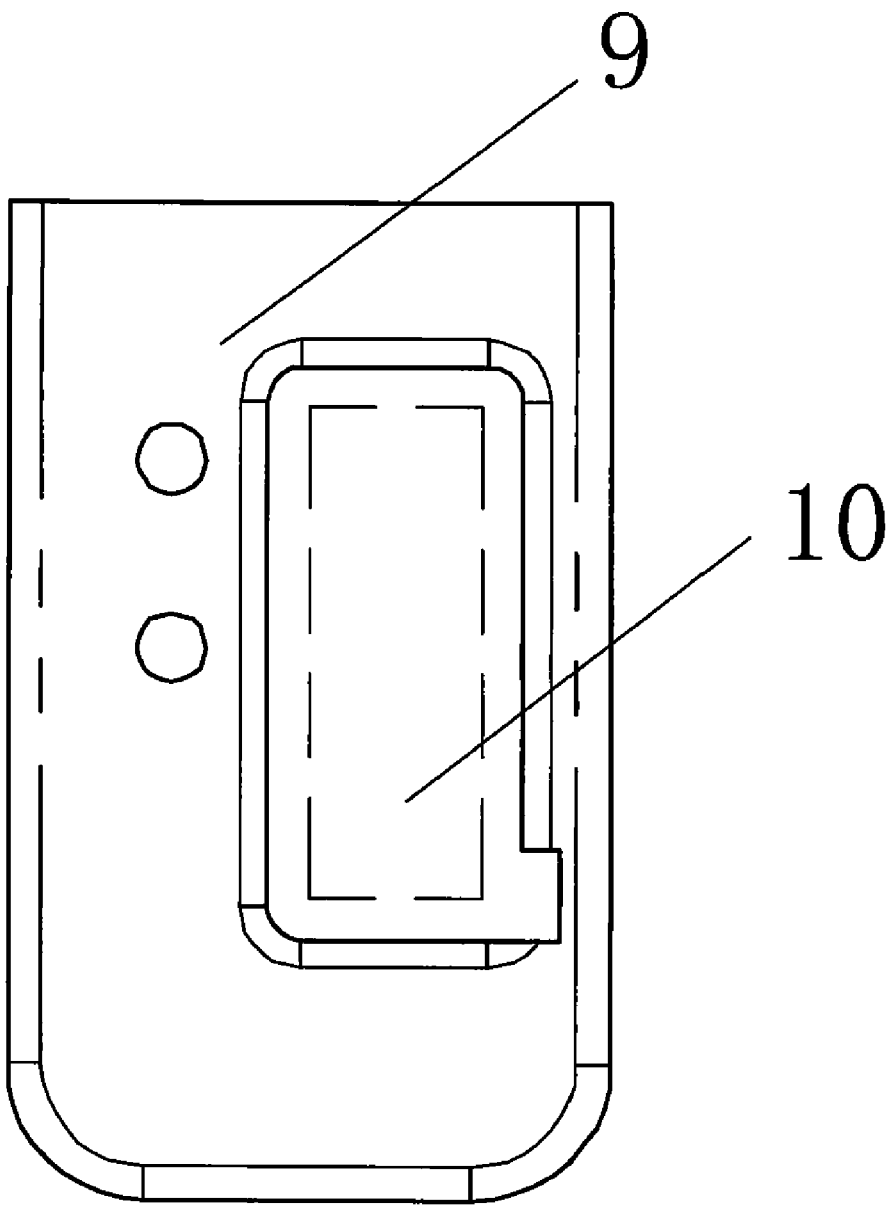
FIG. 7 is a schematic diagram of a fuse tube cover placed on an inner frame cover according to an embodiment of the present invention.
Figure 8:
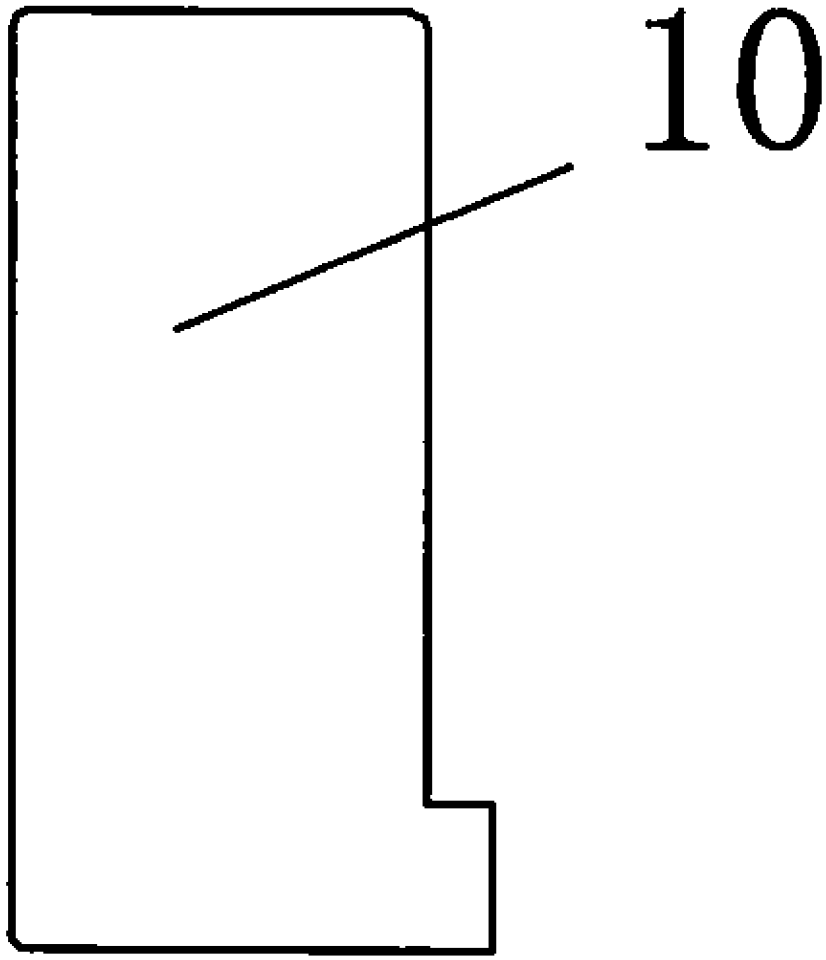
FIG. 8 is a schematic diagram of a fuse tube cover according to an embodiment of the present invention.
Figure 9:
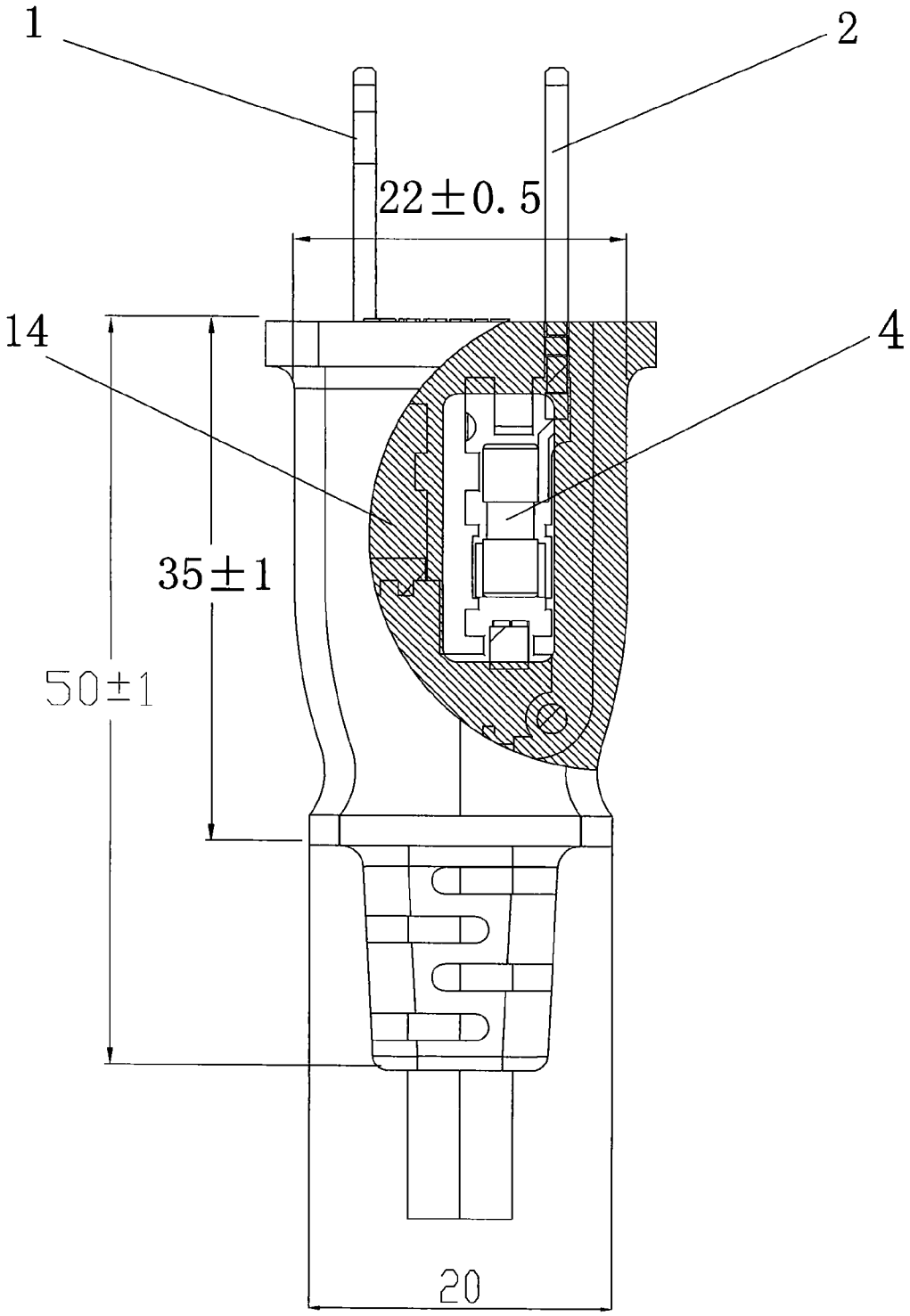
FIG. 9 is a schematic diagram of an overall structure of a power plug having a backup fuse tube according to an embodiment of the present invention.
Figure 10:
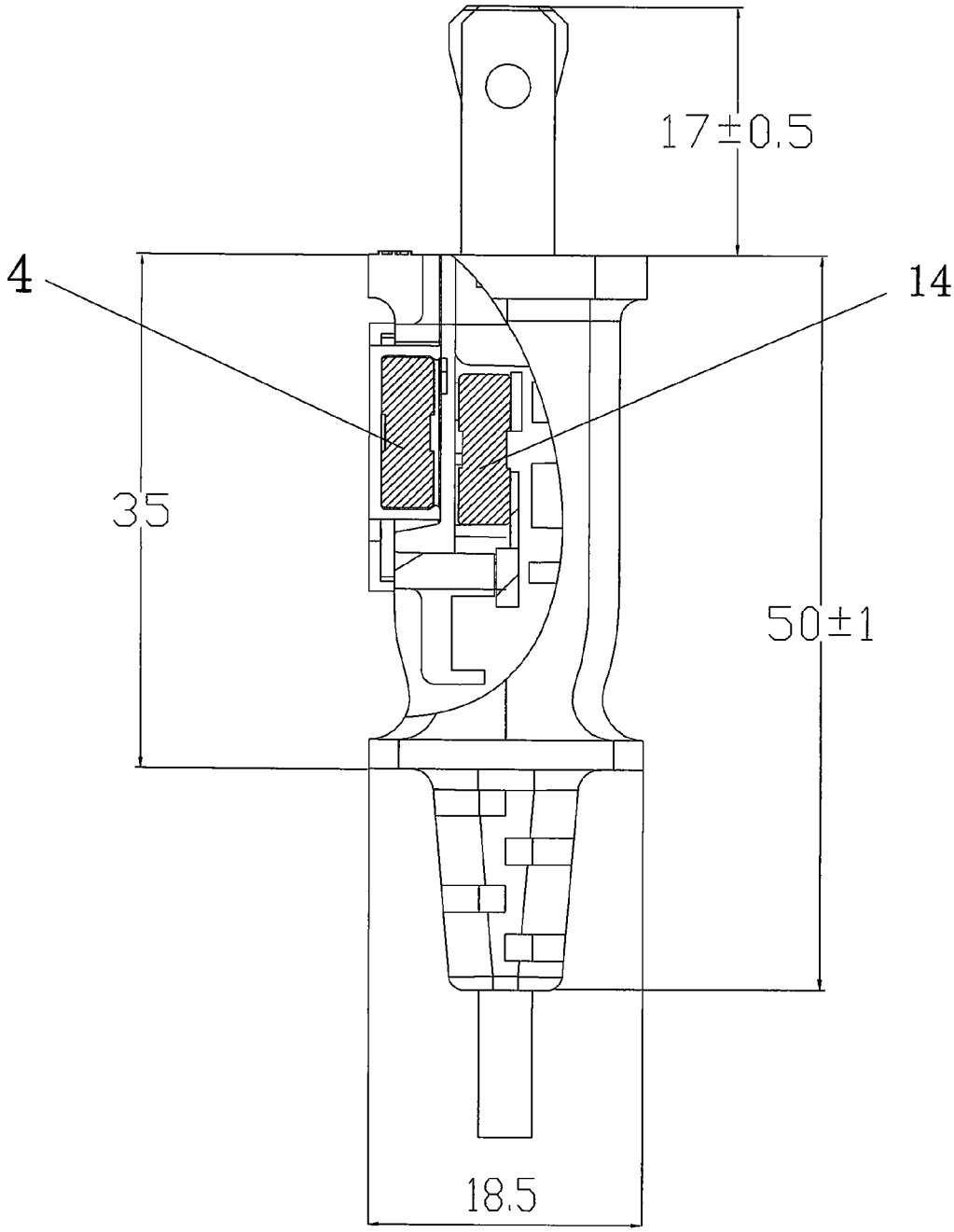
FIG. 10 is a side view of a power plug having a backup fuse tube according to an embodiment of the present invention.

Refer to FIGS. 2 & 4 for a left side view of a power plug having a backup fuse tube according to an embodiment of the present invention, and a schematic diagram of a reverse side cross section of a power plug according to an embodiment of the present invention respectively. As shown in FIGS. 2 & 4, the power plug having a backup fuse tube comprises: pins 1 and 2, a casing 8, lead-out wires 6 and 7; wherein, a cavity 12 is provided in the casing 8, on the cavity 12 is covered with a matching backup fuse tube holder 11, on the backside of the backup fuse tube holder 11 is provided with a retainer 13, and a backup fuse tube 14 is placed in the retainer 13.

In the preferred embodiment of the present invention, in the casing 8 is provided with an inner frame 5 on the other side of a cavity 12, the inner frame 5 is similar to a box, and in the inner frame 5 is provided with pins 1 and 2, lead-out wires 6 and 7, one end of pins 1 and 2 and lead-out wires 6 and 7 are placed in the inner frame 5, while the other ends extend out of the inner frame 5, another cavity is provided in inner frame 5, and a fuse tube stand 3 is in the cavity. One end of fuse tube stand 3 is connected to an inner end of a pin 2, and the other end of fuse tube stand 3 is connected to an inner end of a lead-out wire 6, a fuse tube 4 is provided in the fuse tube stand 3, an inner frame cover 9 is matched with the inner frame 5 and is placed on the inner frame 5, an opening 91 is provided on the inner frame cover 9, the opening 91 is matched with a fuse tube cover 10, the fuse tube cover 10 is placed on the opening.

Moreover, in the preferred embodiment of the present invention, the casing 8 is made of an environment protection thermoplastic PVC material; the pins 1 and 2 are made of H62 copper; the inner frame 5, the fuse tube holder 11, the inner frame cover 9, and the fuse tube cover 10 are made of PBT+GF material having good mechanical, anti-flammable, and insulation properties. In the actual manufacturing process, firstly, preparing an inner frame 5; next, placing pins 1 and 2, lead-out wires 6 and 7 and fuse tube stand 3 into the inner frame 5, and putting on the inner frame cover 9; then, placing the structure thus obtained into a mold to form a casing 8 by means of ejection to mode; then manufacturing separately the fuse tube holder 11 and the fuse tube cover 10; and finally assembling the parts mentioned above in achieving a power plug of the present invention.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A power plug having backup fuse tube, comprising:

pins, a casing, and lead-out wires;

wherein, a cavity is provided in said casing, on an upper cover of said cavity is matching backup fuse tube holder, a backside of said backup fuse tube holder is provided with a retainer, and a backup fuse tube is placed in said retainer, and wherein said casing is provided with an inner frame, and said inner frame is provided with said pins and said lead-out wires, another cavity is provided in said inner frame, and a fuse tube stand is in said cavity, one end of said fuse tube stand is connected to an inner end of said pin, and another end of said fuse tube stand is connected to said inner end of said lead-out wire, a fuse tube is provided in said fuse tube stand, an inner frame cover is matched with said inner frame and is placed on said inner frame, an opening is provided on said inner frame cover, said opening is matched with a fuse tube cover, said fuse tube cover is placed on said opening.

* * * * *